US005699826A

United States Patent [19]

Shiban

[11] Patent Number: 5,699,826

[45] Date of Patent: Dec. 23, 1997

[54] HAZARDOUS GAS MIXING APPARATUS WITH RAKE FOR DISLODGING CONDUIT DEPOSITS

[75] Inventor: Samir S. Shiban, Beaverton, Oreg.

[73] Assignee: Innovative Engineering Solutions, Inc., Beaverton, Oreg.

[21] Appl. No.: 699,722

[22] Filed: Sep. 3, 1996

[51] Int. Cl.[6] ..... B08B 9/04

[52] U.S. Cl. ..... 137/244; 15/104.16; 137/88; 137/624.11; 137/896; 251/129.04

[58] Field of Search ..... 137/88, 242, 244, 137/896, 897, 898, 624.11; 454/261; 15/104.16; 251/31, 129.04

[56] References Cited

U.S. PATENT DOCUMENTS

| | | | |
|---|---|---|---|
| 2,538,947 | 1/1951 | Ragatz | 137/244 |
| 2,707,868 | 5/1955 | Goodman | 137/244 |
| 2,810,434 | 10/1957 | Bramming | 137/244 |
| 2,886,868 | 5/1959 | Dietert et al. | 137/88 |
| 3,230,589 | 1/1966 | McIlvaine | 137/88 |
| 3,367,259 | 2/1968 | Savage, Jr. | 137/897 |
| 3,634,053 | 1/1972 | Klass et al. | 137/88 |
| 3,805,831 | 4/1974 | Culbertson | 137/897 |
| 3,807,938 | 4/1974 | Hastings | 137/244 |
| 4,078,576 | 3/1978 | Punch et al. | 137/897 |
| 5,353,829 | 10/1994 | Shiban | 137/88 |

*Primary Examiner*—George L. Walton
*Attorney, Agent, or Firm*—James D. Givnan, Jr.

[57] ABSTRACT

An apparatus is disclosed for mixing ambient air and a hazardous gas with the gas being admitted to the apparatus via an inlet conduit. A rake disposed for travel within said conduit periodically dislodges deposits from the conduit interior with rake travel being along conduit affixed guides. Openings defined by the rake permit a gas flow at all times. Projections on a conduit end wall dislodge deposits from disc edges defining openings. A rake actuator is in communication with a solenoid valve in circuit with a timer and controller for automatic operation of the actuator.

6 Claims, 1 Drawing Sheet

HAZARDOUS GAS MIXING APPARATUS WITH RAKE FOR DISLODGING CONDUIT DEPOSITS

BACKGROUND OF THE INVENTION

The present invention concerns generally an apparatus for the mixing of a hazardous gas flow with an air flow to render the gas inert.

U.S. Pat. No. 5,353,829, issued to the present inventor, is incorporated herein by reference and shows an apparatus having a chamber into which a hazardous gas is drawn for mixing with random air currents. An inlet conduit, through which hazardous gas is discharged into the chamber, is subject to having deposits form thereon which heretofore necessitated interruption of the mixing operation for removal of such deposits. Such maintenance efforts are time consuming and incur a costly shutdown of certain manufacturing tasks. Further such deposits, if not removed, could prevent operation of the apparatus. The apparatus disclosed in the above noted patent has been modified to include means for removal of accumulations of particulate from the conduit interior. A pneumatic cylinder periodically drives a scraper element through the conduit. No provision was made however for automaticaly removing accumulations forming on the scraper or rake element.

SUMMARY OF THE PRESENT INVENTION

The present invention includes a rake for periodic removal of conduit deposits with means provided to dislodge deposits forming on the rake or scraper without interruption in the operation of a gas mixing apparatus.

The present invention is utilized in an apparatus for mixing hazardous gasses with an air flow in a ratio so as to reduce hazardous gas to an inert state. The gas is directed to a chamber of the apparatus by means of an inlet conduit the internal walls of which receive an accumulation of particulate. Disposed in an inlet conduit segment is a rake for rectilinear, periodic travel to dislodge such material. Openings in a disc shaped rake member permit a continuous flow of the hazardous gas during rake operation. Periodically the rake member is subjected to projections located on a conduit end plate for removal of deposits. A power source for the rake is disclosed as an air cylinder controlled by a solenoid valve and timer. The rake is supported for rectilinear movement along the inlet conduit by guides which permit travel of the rake beyond the conduit end ensuring complete discharge of the dislodged material.

Important objectives of the present invention include the provision of a rake assembly for periodically removing deposits from the inlet conduit of an air/gas mixing apparatus without shutdown of manufacturing efforts generating the hazardous gas by including means for maintaining open areas of the rake free of deposits and always open to the passage of a hazardous gas therepast to prevent impeding a hazardous gas flow through the apparatus.

DETAILED DESCRIPTION OF THE PREFERRED EMBODIMENTS

Figure 1:
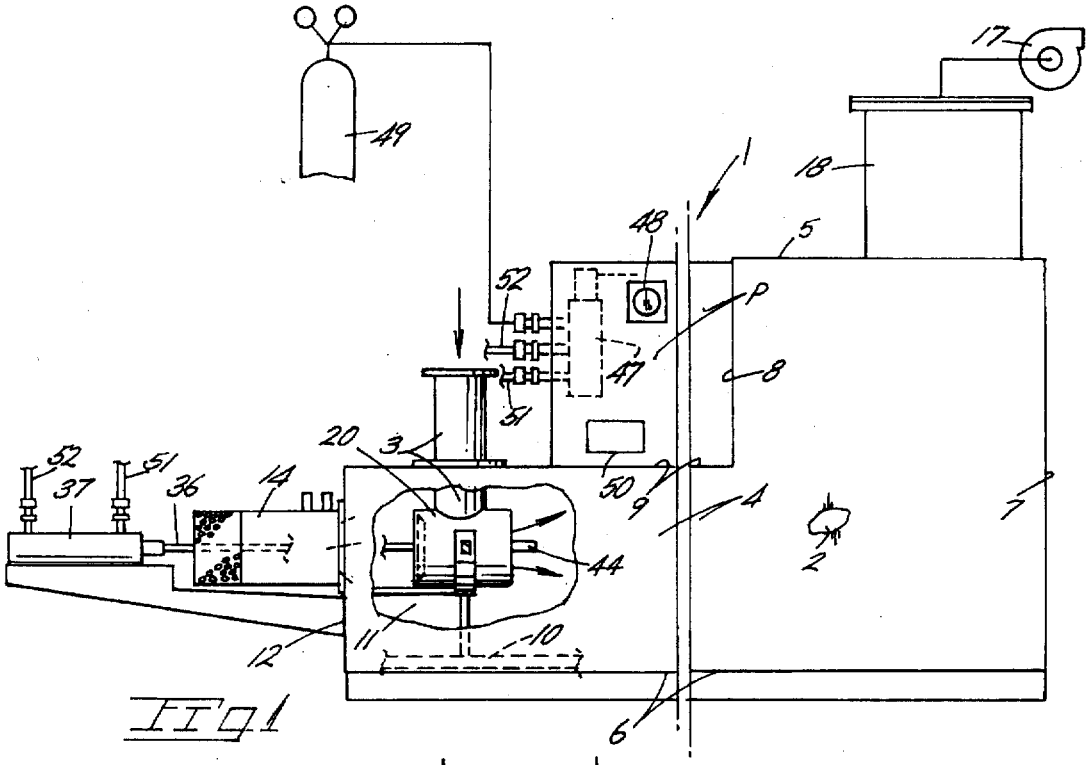
FIG. 1 is a front elevational view showing the hazardous gas mixing apparatus with fragments broken away and provided with the present invention.
Figure 3:
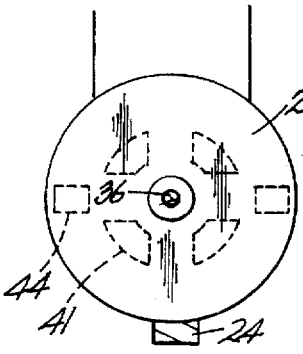
FIGS. 3 and 4 are end elevational views taken respectively from the left end and the right end of FIG. 2.

With continuing attention to the drawings wherein applied reference numerals indicate parts similarly hereinafter identified, the reference numeral 1 indicates generally a hazardous gas mixing apparatus disclosed in U.S. Pat. No. 5,353,829 incorporated herein by reference. The housing 1 defines a chamber 2 receiving a flow of a hazardous gas via an inlet conduit 3.

Housing side walls are at 4, at least one of which is removably mounted on an apparatus framework 10, while a top wall is at 5. A bottom wall 6 terminates at an end wall 7 intermediate upright wall indicated at 8. A second top wall 9 of the apparatus partially defines an inlet area of chamber 2 also partially defined by an end wall 12 of the apparatus. Wall 12 defines an opening 12A for the reception of ambient air which passes through a diffuser 13 diverting incoming air passing wall opening 12A from an ambient air inlet structure at 14. Fins as at 16 of the diffuser divert incoming ambient air away from flowing in an axial manner through inlet chamber 11 of the mixing apparatus. Flows of a hazardous gas and of ambient air into the apparatus are induced by a source of below atmospheric pressure as by the intake side of a blower at 17 via an outlet duct 18.

With attention now to the present improvement to the mixing apparatus 1, an inlet conduit 20 in chamber 2 receives a hazardous gas flow from conduit 3 in upstream communication with the source of a hazardous gas. Inlet conduit segment 20 may be of cylindrical shape, having an end plate 21 with an open end at 22. Supports at 23, 24 and 25 for conduit segment 20 project outwardly therefrom and from a saddle at 26, secured to the outer wall of inlet conduit 20. Accordingly inlet 20 is supported in place against displacement during operation of a later described rake assembly. Deposits may be dislodged through an opening 27 in conduit 20. Inlet conduit 20, as well as other components of the present invention, are preferably formed of stainless steel to resist the corrosive actions of the hazardous gases being mixed with ambient air.

Figure 2:
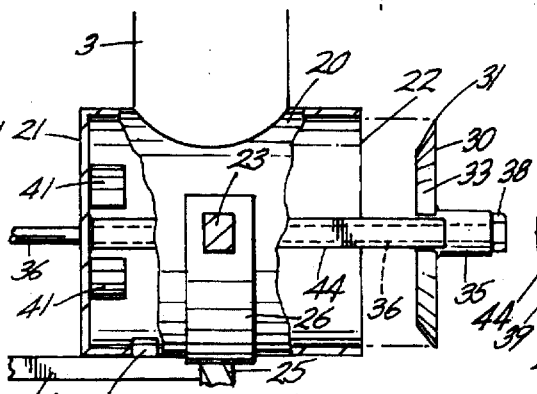
FIG. 2 is an enlarged front elevational view of a hazardous gas inlet conduit with a rake for removing conduit deposits.
Figure 4:
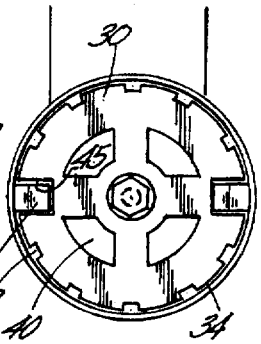
Figure 5:
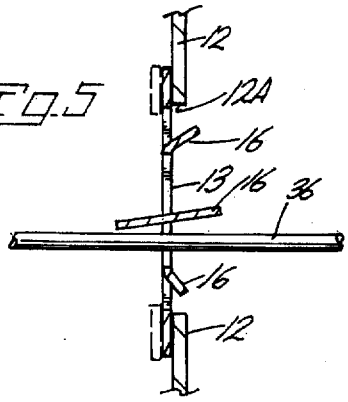
FIG. 5 is an enlarged vertical sectional view of a diffuser plate of the hazardous gas mixing apparatus.

A rake at 30 dislodges deposits from the conduit and is of a size and disc shape to locate an outer edge 31 proximate to an inner wall surface 32 of the inlet conduit. The rake has a rearwardly and inwardly beveled edge 33 to provide an acutely angled outer edge 31 effective to dislodge particles from conduit wall surface 32. Outer edge 31 may be bifurcated at 39 at intervals thereabout to define rake teeth at 34. In place on the forward side of the rake is a sleeve 35 centrally disposed and bored to receive the inserted outer end of a push rod 36 actuated by an air cylinder 37 mounted exteriorly of the mixing apparatus. The distal end of rod 36 receives threaded fastener 38 to lock the rod to the rake. From the above it will be seen that actuation of double acting cylinder 37 will impart rectilinear movement to rake 30 from a position at rest adjacent to inlet closure plate 21 to the forward extent of travel shown in full lines in FIG. 2. During such travel beveled edge 31 travels along internal wall 32 of conduit 20 to free same of deposits which deposits occur during entry of the hazardous gas into conduit 20 and encounters reduced temperatures and a change in direction. The disc shaped rake 30 is provided with a series of openings at 40 which permit hazardous gas passage past the rake in the event same is stopped mid-stroke by a malfunction preventing its normal stroke or cycle outward or away from end plate 21 and return thereto. The openings 40 correspond closely in size and shape to projections 41 on end plate 21 which serve to dislodge deposits collecting on the rake edges defining openings 40 to ensure hazardous gas flow past the plate at all times during rake travel. Guide bars at 44, affixed to the interior of inlet conduit segment 20, serve to carry rake 30 with the guides being received within recesses 45 in the rake periphery. It will be noted that the guide bars 44 project beyond open end 22 of inlet conduit 20 to permit rake 30 to travel beyond conduit segment open end 22 fully dislodging any particulate broken away from inner wall surface 32 by 20 the rake and to an unobstructive position regarding gas flow.

In operation of the present apparatus, rake 30 is intermittently extended and retracted by cylinder 37 to cause rake edge 31 to scrape the interior of conduit 20 to dislodge particulate deposited thereon. Rake teeth 34 are spaced about rake edge 31 for such scraping. Opening 27 in conduit 20 permits discharge of particulate loosened by rake 30 during its return travel toward closure plate 21 of the conduit. The rake defined openings 40 permit the flow of hazardous gas through the rake during outward and inward travel of same during a particulate dislodging operation. The guide bars 44 support rake 30 during rectilinear travel of same outward and thence inwardly with the rake coming to rest against closure plate 21 whereat the projections 41 protrude through openings 40 in the rake to dislodge any particulate deposited on the edge of plate 30, defining openings 40 which would otherwise tend to reduce the area of openings 40.

Double acting cylinder 37 of a rake control system extends and retracts rake 30 preferably in a rapid manner with cylinder actuation being controlled by a solenoid valve 47 in circuit with a timer 48 and served by a pressure source 49. A controller at 50 on a control panel P may be set to actuate timer 48 which in turn controls solenoid valve 47 and cycling of cylinder 37. Air lines are at 51 and 52.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

I claim:

1. In an apparatus for mixing a hazardous gas with air in a chamber to render the hazardous gas inert, the improvement comprising, hazardous gas conduit structure in said chamber and including an end plate, a rake supported for rectilinear travel in said conduit structure and having a perimetrical edge proximate an internal wall surface of the conduit structure for cleaning said conduit structure, said rake having a static rest position adjacent said end plate, an actuator imparting movement to said rake to remove hazardous gas deposits from the internal wall surface of said conduit structure, a rake control system for automatic actuation of said actuator at timed intervals to impart movement to said rake, said rake defining an opening through which a hazardous gas may pass, and said hazardous gas conduit structure including a projection on said end plate for insertion into said opening in said rake to remove accumulated deposits therein to ensure the passage of hazardous gas through the rake defined opening during rake travel through the hazardous gas conduit structure.

2. The improvement claimed in claim 1 additionally including guides carried by said conduit structure and along which said rake travels, said guides extending along said conduct structure and supporting said rake.

3. The improvement claimed in claim 2 wherein said guides extend beyond said conduit structure, said rake at one extreme of rake travel along said guides offset from the inlet conduit structure.

4. The improvement claimed in claim 1 wherein said rake is of disc configuration having a beveled marginal surface.

5. The improvement claimed in claim 4 wherein a peripheral edge of said rake defines openings at intervals to define teeth about said edge.

6. The improvement claimed in claim 1 wherein said hazardous gas conduit structure defines an opening adjacent said end plate through which deposits dislodged by the rake may exit the conduit.

* * * * *